US012292224B2

(12) United States Patent
Bai et al.

(10) Patent No.: US 12,292,224 B2
(45) Date of Patent: May 6, 2025

(54) REFRIGERATOR

(71) Applicant: Thetford BV, Etten-Leur (NL)

(72) Inventors: Hao Bai, Liangning Province (CN); Pieter-Dirk Berkhout, Dordrecht (NL); Joost Marinius Van Rooijen, Kapelle (NL); Leendert Jan Antoon Jansen, Rotterdam (NL)

(73) Assignee: Thetford BV, Etten-Leur (NL)

( * ) Notice: Subject to any disclaimer, the term of this patent is extended or adjusted under 35 U.S.C. 154(b) by 193 days.

(21) Appl. No.: 17/892,196

(22) Filed: Aug. 22, 2022

(65) Prior Publication Data

US 2023/0068630 A1 Mar. 2, 2023

Related U.S. Application Data

(60) Provisional application No. 63/236,807, filed on Aug. 25, 2021.

(51) Int. Cl.

| | |
|---|---|
| ***F25D 17/08*** | (2006.01) |
| ***F25D 11/02*** | (2006.01) |
| ***F25D 17/06*** | (2006.01) |

(52) U.S. Cl.

CPC ..... *F25D 17/08* (2013.01); *F25D 11/02* (2013.01); *F25D 17/065* (2013.01)

(58) Field of Classification Search

CPC ..... F25D 23/003; F25D 17/08; F25D 11/02; F25D 17/065; F25D 2317/062; F25D 2317/067; F25D 2323/0021; F25D 2323/02

See application file for complete search history.

(56) References Cited

U.S. PATENT DOCUMENTS

| | | | | |
|---|---|---|---|---|
| 2,692,482 | A * | 10/1954 | Shoemaker | F25D 17/062 62/526 |
| 2,745,259 | A | 5/1956 | Saunders | |
| 2013/0065502 | A1 * | 3/2013 | Zanqueta | F24C 15/322 454/195 |

FOREIGN PATENT DOCUMENTS

| | | | |
|---|---|---|---|
| KR | 20050028773 | A * | 3/2005 |
| KR | 20050094672 | A * | 9/2005 |

(Continued)

OTHER PUBLICATIONS

European Search Report Received in corresponding European application No. 22020409.3 dated Mar. 24, 2023.

(Continued)

*Primary Examiner* — Ana M Vazquez

(74) *Attorney, Agent, or Firm* — Harness, Dickey & Pierce, P.L.C.; Stephen T. Olson

(57) ABSTRACT

A refrigerator includes a housing defining an interior, a freezer disposed within the interior, and a cooling unit for cooling the interior of the refrigerator. The freezer has a freezer door. At least one ventilation duct vertically extends through the freezer door. The at least one ventilation duct has a first end in communication with an upper zone of the interior of the refrigerator. An airflow path extends between a heat exchanger and a lower end of the at least one ventilation duct. A cooling fan is disposed within the interior of the refrigerator for directing a source of air across the heat exchanger, along the airflow path, through the at least one ventilation duct and into the upper zone of the interior of the refrigerator.

19 Claims, 8 Drawing Sheets

(56) References Cited

FOREIGN PATENT DOCUMENTS

| | | | |
|---|---|---|---|
| SU | 1559243 | A1 | 4/1990 |
| WO | 2011106856 | A2 | 9/2011 |

OTHER PUBLICATIONS

Australian Examination Report received in corresponding Australian Application No. 2022221455, dated Jun. 19, 2023.

* cited by examiner

REFRIGERATOR

CROSS-REFERENCE TO RELATED APPLICATIONS

This application claims the benefit of U.S. Provisional Application No. 63/236,807, filed on Aug. 25, 2021. The entire disclosure of the above application is incorporated herein by reference.

FIELD

The present disclosure relates generally to refrigerators. More particularly, the present disclosure relates to various aspects of a refrigerator applicable for vehicle and non-vehicle applications.

BACKGROUND

This section merely provides background information related to the present disclosure and may not constitute prior art.

Vehicles, including but not limited to, camper vans, recreational vehicles ("RVs", in the United States and "Caravans" or "Mobile Homes" in Europe), trucks, tractor trailers, airplanes, boats, trains and the like, often incorporate refrigerators for the comfort and convenience of the occupants. For example, campers often find it convenient, or even necessary, to refrigerate food, drinks, and medicine during their journey and while at their campsites. Thus, a popular solution has been to equip the recreational vehicle with a refrigerator.

Known refrigerators for vehicles have proven to be generally acceptable for their intended uses. A continuous need for improvement to vehicle refrigerators and other refrigerators, however, is always desired.

SUMMARY

This section provides a general summary of the disclosure, and is not a comprehensive disclosure of its full scope or all of its features.

It is a general object of the present teachings to provide more efficient cooling for an upper zone of the refrigerator.

It is a more particular, related object of the present teachings to provide air ducts that extend through a freezer door to route cooling air from an evaporator section of the refrigerator to an upper zone of the refrigerator.

It is another general object of the present teachings to provide a refrigerator having a cooling unit that has better performance with lower energy consumption, is faster to install, has reduced noise, is easier to service and is easier to diagnose.

In accordance with one particular aspect, the present teachings provide a refrigerator including a housing defining an interior, a freezer disposed within the interior, and a cooling unit for cooling the interior of the refrigerator. The freezer has a freezer door. The cooling unit includes a heat exchanger disposed within the interior of the housing. At least one ventilation duct vertically extends through the freezer door. The at least one ventilation duct has a first end in communication with an upper zone of the interior of the refrigerator. An airflow path extends between the heat exchanger and a lower end of the at least one ventilation duct. A cooling fan is disposed within the interior of the refrigerator for directing a source of air across the heat exchanger, along the airflow path, through the at least one ventilation duct and into the upper zone of the interior of the refrigerator.

In accordance with another particular aspect, the present teachings provide a refrigerator a housing defining an interior, a heat exchanger disposed in the interior, and a cooling unit for cooling the interior. The cooling unit includes a cooling unit housing located at a rear side of the refrigerator. The cooling unit housing defines a U-shaped airflow path extending between an inlet and an outlet. The inlet and the outlet are located at a common lateral side of the refrigerator.

Further areas of applicability will become apparent from the description provided herein. The description and specific examples in this summary are intended for purposes of illustration only and are not intended to limit the scope of the present disclosure.

DRAWINGS

The present teachings will become more fully understood from the detailed description, any appended claims and the following drawings. The drawings are for illustrative purposes only and are not intended to limit the scope of the present disclosure.

DETAILED DESCRIPTION OF VARIOUS ASPECTS

Figure 1:
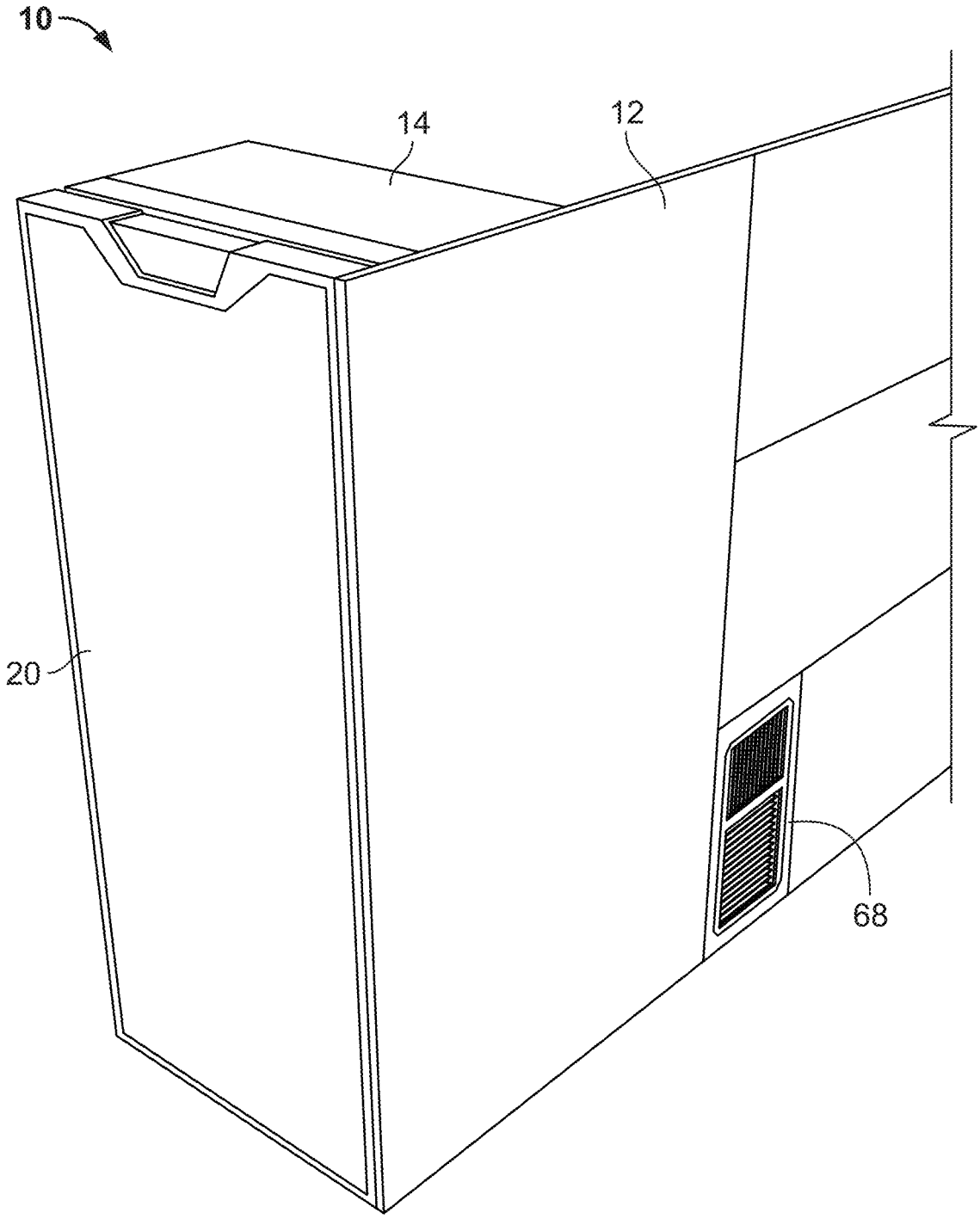
FIG. 1 is a perspective view of a refrigerator in accordance with the present teachings, the refrigerator shown built into a cabinet of a motor vehicle such as a caravan.
Figure 2:
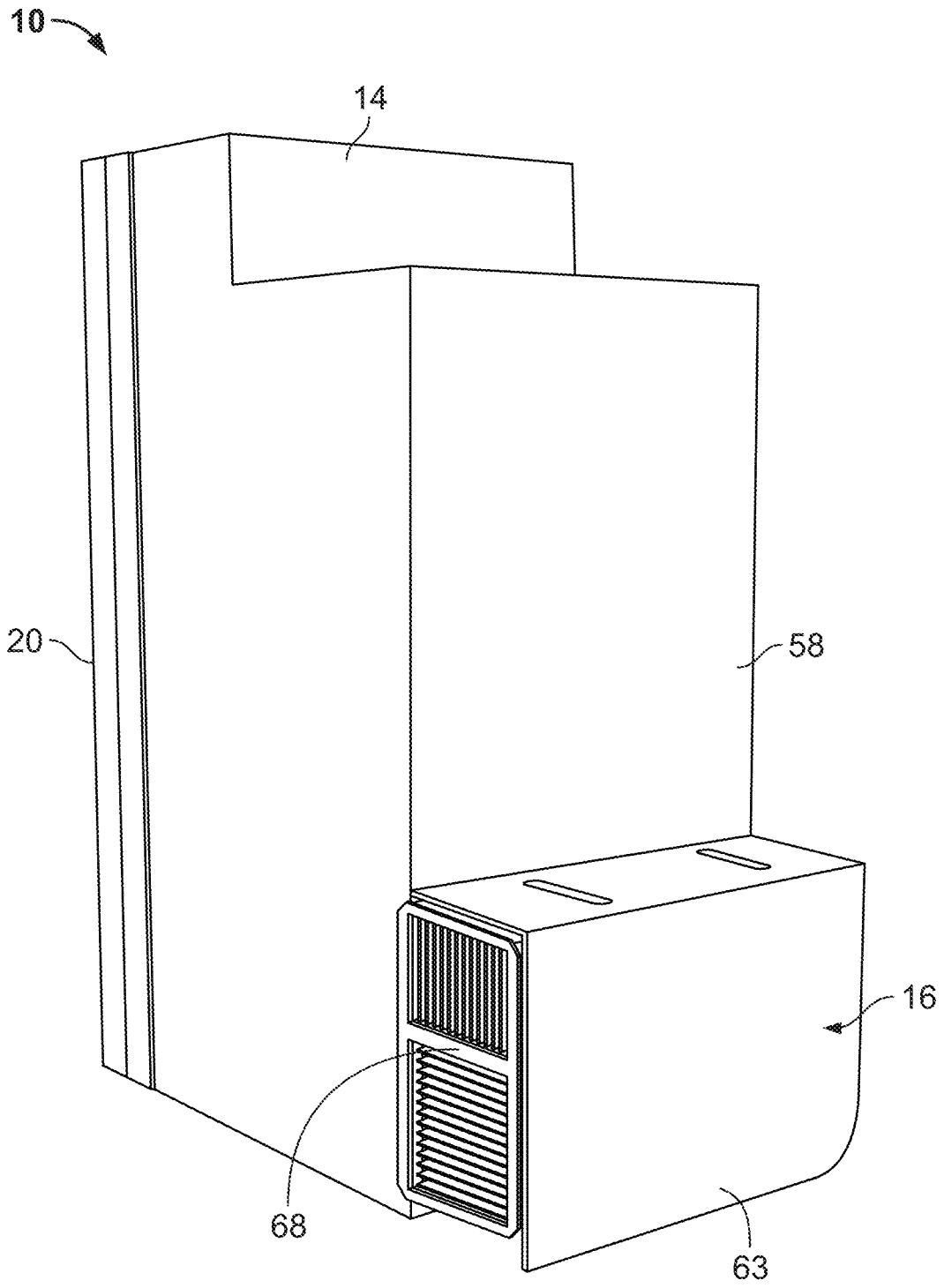
FIG. 2 is another perspective view of the refrigerator of the present teachings.

The following description is merely exemplary in nature and is not intended to limit the present disclosure, its application, or uses. It should be understood that throughout the drawings, corresponding reference numerals indicate like or corresponding parts and features.

With general reference to the FIGS. 1-6 of the drawings, a refrigerator constructed in accordance with the present teachings is illustrated and generally identified at reference character 10. As will be further appreciated below, the present teachings provide a refrigerator 10 particular suitable for use within a caravan or other vehicle. It will be understood, however, that the present teachings are not so limited and may be adapted for other, non-mobile applications. In FIG. 1, the refrigerator 10 is shown built into a cabinet 12 of a motor vehicle.

Before addressing the particular aspects of the present teachings, a more general description of the refrigerator shown throughout the drawings is warranted. The refrigerator 10 is shown to generally include a housing 14 and a cooling unit 16 for cooling an interior 18 of the housing 14. The interior 18 of the housing 14 is accessed through a refrigerator door 20 pivotally connected to the housing 14 in a conventional manner. In the embodiment illustrated, the refrigerator 10 includes a single door 20. In other embodiments within the scope of the present teachings, the refrigerator 10 may include two or more doors. The refrigerator 10 may include a bottom drawer 22, a middle drawer 24, a door bin 26 and a freezer 28. The bottom drawer 22 may be slidably disposed in a lower zone 18A of the interior 18 of the refrigerator 10. The door bin 26 may be carried by the door 20 and disposed in an upper zone 18B of the interior 18 of the refrigerator 10. The middle drawer 24 may be vertically located between the bottom drawer 22 and the door bin 26 in an intermediate zone 18C of the interior 18 of the refrigerator 10. The freezer 28 may be normally closed by a freezer door 29. As illustrated, access to the freezer door 29 is horizontally behind the upper zone 18B of the interior 18 of the refrigerator 10.

The cooling unit 16 of the refrigerator 10 generally includes a compressor 30, a ventilator 32, a condensation tray 34, and a condenser 36. In the embodiment illustrated, the condenser is a wire-style condenser 36. The various components of the cooling unit 16 may be housed within a cooling unit housing 38. The condenser 36 is in operative communication with a heat exchanger or evaporator 40 located a rear of the interior of the refrigerator 10.

The present teachings provide for more efficient cooling of the upper zone 18B of the interior 18 with at least one ventilation duct 42 that vertically extends through the freezer door 29. As shown perhaps most particularly in the cross section of FIG. 5, in the embodiment illustrated the freezer door 29 includes a pair of ventilation ducts 42 vertically extending through the freezer door 29. The freezer door 29 may define a freezer handle. The at least one ventilation duct 42 may pass through the freezer handle. An interior 44 of the freezer door 29 is otherwise shown foamed with an insulation 46.

Each ventilation duct 42 has a first or upper end 42A in communication with the upper zone 18B of the interior 18 of the refrigerator 10 and a second or lower end 42B. An airflow path 48 extends between the heat exchanger 40 and the lower ends 42B of each ventilation duct 42. More particularly, the airflow path 48 includes a vertically extending section adjacent to the heat exchanger 40. The air from within the refrigerator 10 that is directed into the airflow path 48 by a cooling fan 52 is cooled within the vertically extending portion of the airflow path 48. The airflow path 48 also include a horizontally extending portion below the freezer 28 that extends between the vertically extending portion and the ventilation ducts 42. A guide blade 50 is provided at the lower end 42 of the ventilation ducts 42 to assist with the transition of airflow from the airflow path 48 to the ventilation ducts 42.

Figure 3:
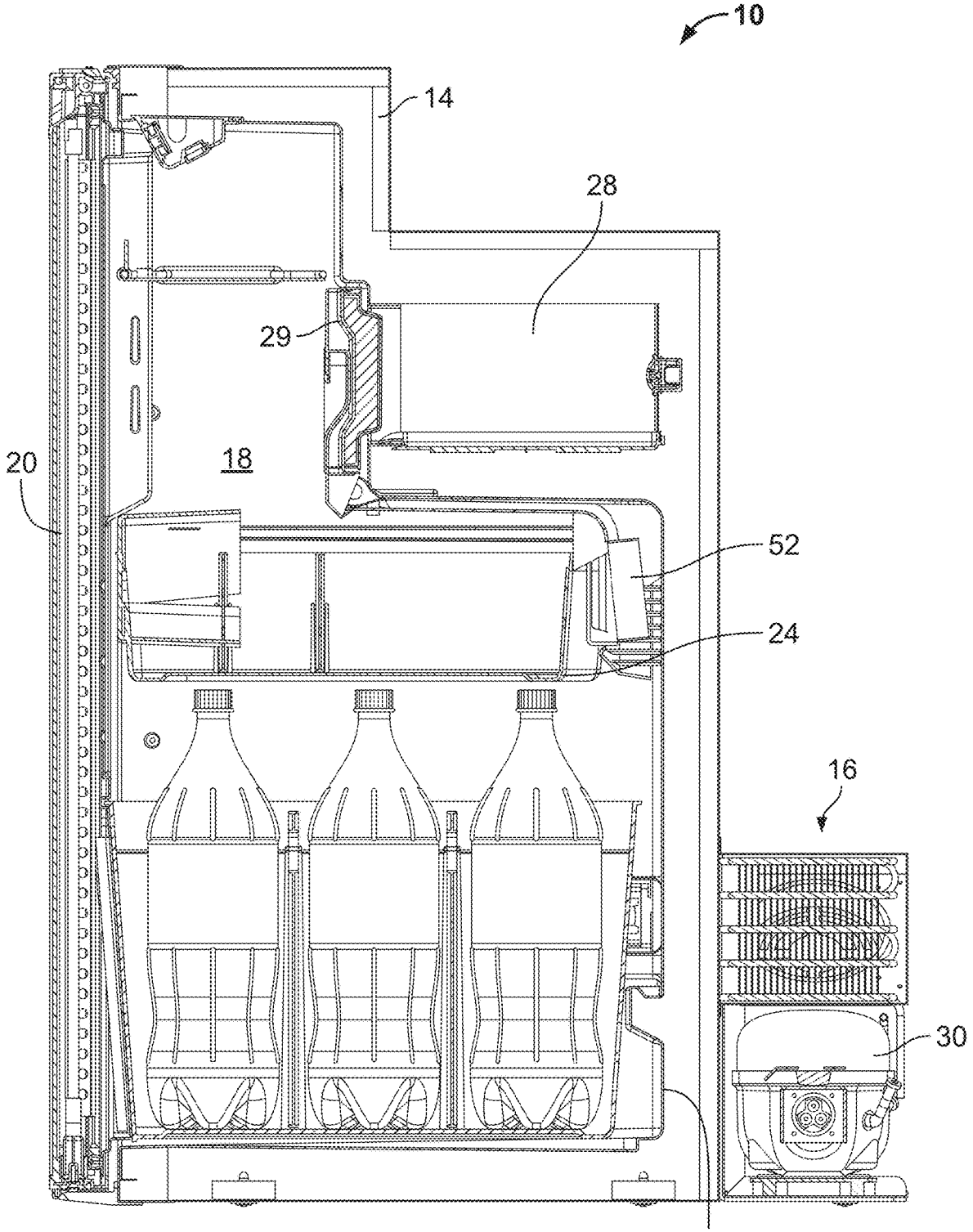
FIG. 3 is cross-sectional view taken through the refrigerator.
Figure 4:
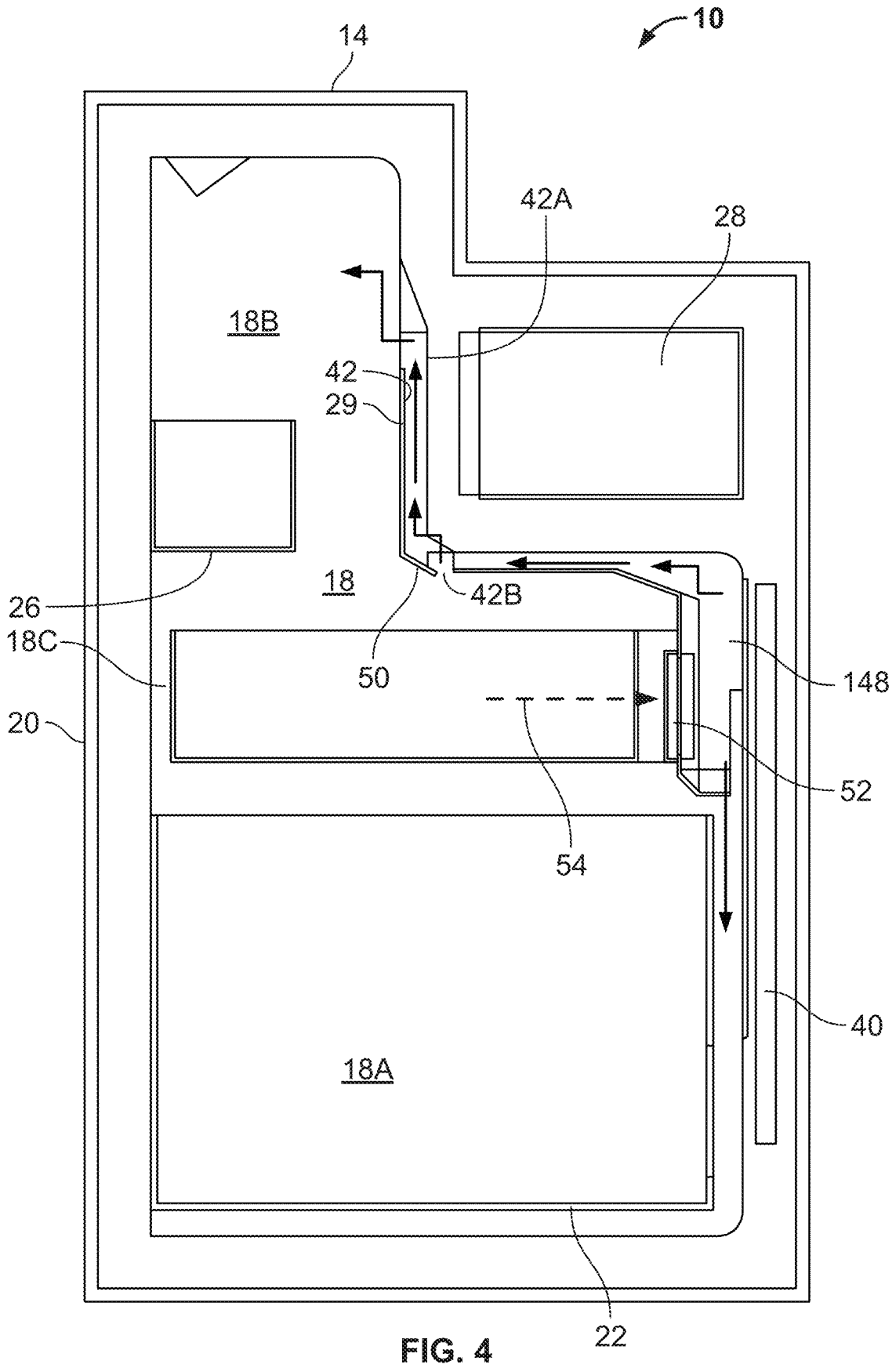
FIG. 4 is a simplified cross-sectional view similar to FIG. 3 illustrating the air flow within the refrigerator.
Figure 5:
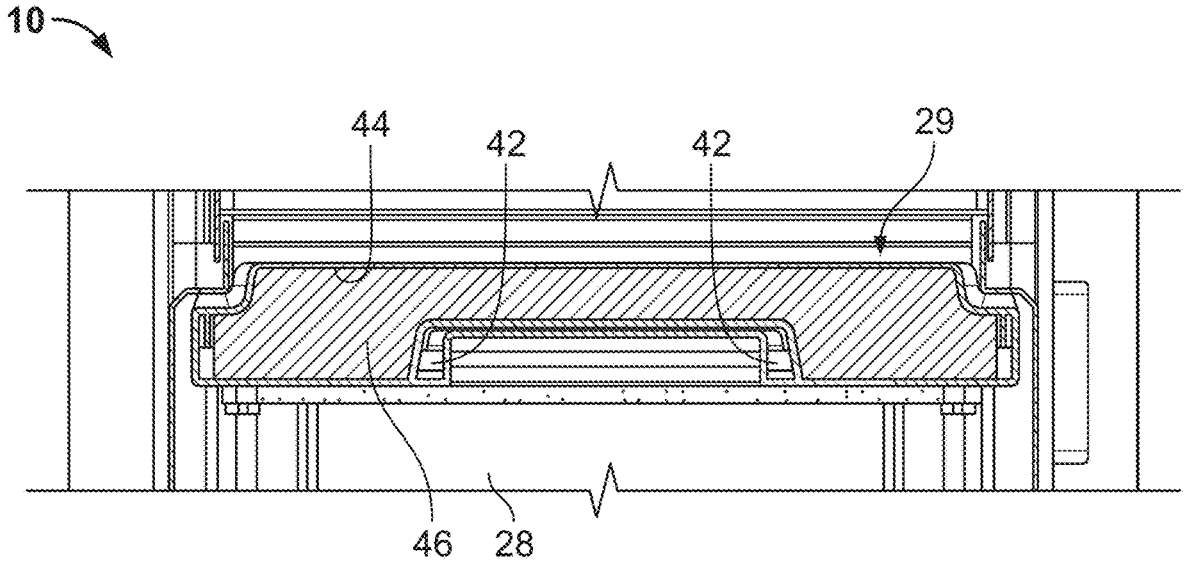
FIG. 5 is a cross-sectional view taken through a freezer door of the refrigerator.
Figure 6:
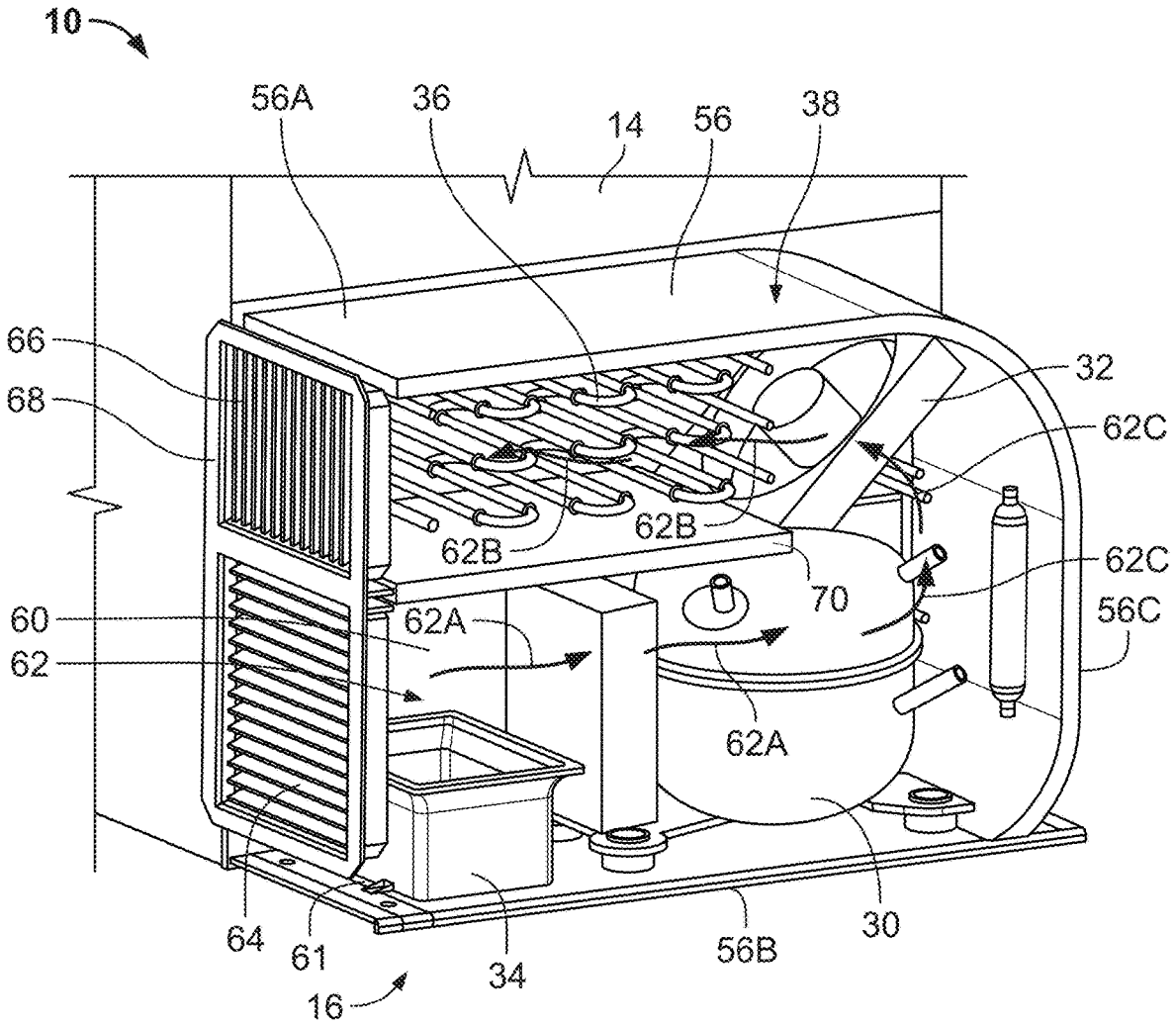
FIG. 6 is a rear perspective view of a portion of the refrigerator in accordance with the present teachings.

The cooling fan 52 is disposed within the interior 18 of the refrigerator 10. As illustrated, the cooling fan 52 is located horizontally behind the middle drawer 24 between the middle drawer 24 and the heat exchanger 40. In this regard, the cooling fan 52 may be mounted on a forwardly facing wall defining a portion of the airflow path 42 immediately behind the middle drawer 24. In other applications, the cooling fan 52 may be mounted to and carried by the middle drawer 24. The cooling fan 52 operates to direct a source of air across the heat exchanger 40, along the airflow path 48, through the at least one ventilation duct 42 and into the upper zone 18B of the interior 18 of the refrigerator 10. Cooling air may also be directed in an opposite, downward direction. The direction of air drawn into the cooling fan 52 is shown at arrow 54. The other arrows of FIG. 4 show the flow of cooled air from the heat exchanger 52. As shown in FIG. 3, the cooling fan 52 may be oriented upwardly to direct a greater amount of cooled air to the upper zone 18B of the interior 18.

In operation, the cooling fan 52 may be controlled to direct air against the heat exchanger 40 for cooling, upwardly along the airflow path 48, through the ventilation ducts 42 of the freezer door 29 and into the upper zone 18B of the interior 18 of the refrigerator 10. As shown in FIG. 4, the upper ends 42A of the ventilation ducts 42 may be in a front face of the freezer door 29. Air may also be directed downwardly from the heat exchanger 40. In this manner, internal airflow within the refrigerator 10 may be optimized to ensure that the various zones of the refrigerator 10 are efficiently cooled. The cooling fan 52 may be controlled to run both with and without operation of the compressor. In certain applications, it may be desired to continuously or almost continuously operate the cooling fan 52 to provide sufficient cooling to the upper zone 18B without overcooling other zones of the refrigerator 10.

The present teachings provide a solution for efficiently cooling an upper zone 18B of the interior 18 where the heat exchanger 40 is centrally located within the refrigerator 10 while avoiding the incorporation of complicated air ducting. This solution also provides a clean and desirable appearance within the refrigerator 10. In one application, the upper zone 18B of the interior 18 may be maintained within a desired temperature range between 0 and 8 degrees Celsius.

The cooling unit housing 38 is located at a rear side 58 of the refrigerator 10. In the embodiment illustrated, the cooling unit housing 38 may have a U-shaped sidewall 56 having a first or top wall 56A, a second or bottom wall 56B and a third or intermediate side wall 56C connecting the top and bottom walls 56A and 56B. The first and third side walls 56A and 56C may be formed together. The second side wall 56B may be separately formed and may define a floor of the cooling unit 16. The sidewall 56 of cooling unit housing 38 is open to an interior 60 of the cooling unit 16 at an open side 61. The open side 61 is located at a lateral side of the refrigerator 10.

The cooling unit housing 38 defines an airflow path 62. The airflow path may be a U-shaped airflow path 62 extending between an inlet 64 and an outlet 66. The inlet and the outlet 64 and 66 are located at a common lateral side of the refrigerator 10. The refrigerator 10 includes a side vent 68 removably attached to the cooling unit housing 38 and covering the inlet and the outlet 64 and 66. As the removable side vent 68 is located on the lateral side of the refrigerator 10, the components of the cooling unit 16 may be more easily accessed for diagnosis and repair from an interior of the vehicle without removing the refrigerator 10. The cooling unit 16 may also include a removable shell 63 that closes an open rear side of the cooling unit housing 38.

The airflow path 62 includes a first portion 62A horizontally extending into the cooling unit housing 38 from the inlet 64 and a second portion 62B horizontally extending to the outlet 66. An arcuate portion 62C connects the first and second portions 62A and 62B. A divider wall 70 is horizontally oriented in the cooling unit housing 38 and separates the first and second portions 62A and 62B of the airflow path 62. The compressor 30 is disposed within the first portion of the airflow path 62A. The condenser 36 is disposed in the second portion 62B of the airflow path 62. The ventilator 32 located in the airflow path 62 at a transition between the third portion 62C and the second portion 62B.

The refrigerator 10 of the present teachings including cooling unit 16 provides the added benefit of a more secure fixation to the vehicle. As the installation point is freely accessible from the side, the installation point can be adapted per vehicle, making a stronger connection between the refrigerator 10 and the vehicle possible.

Figure 7:
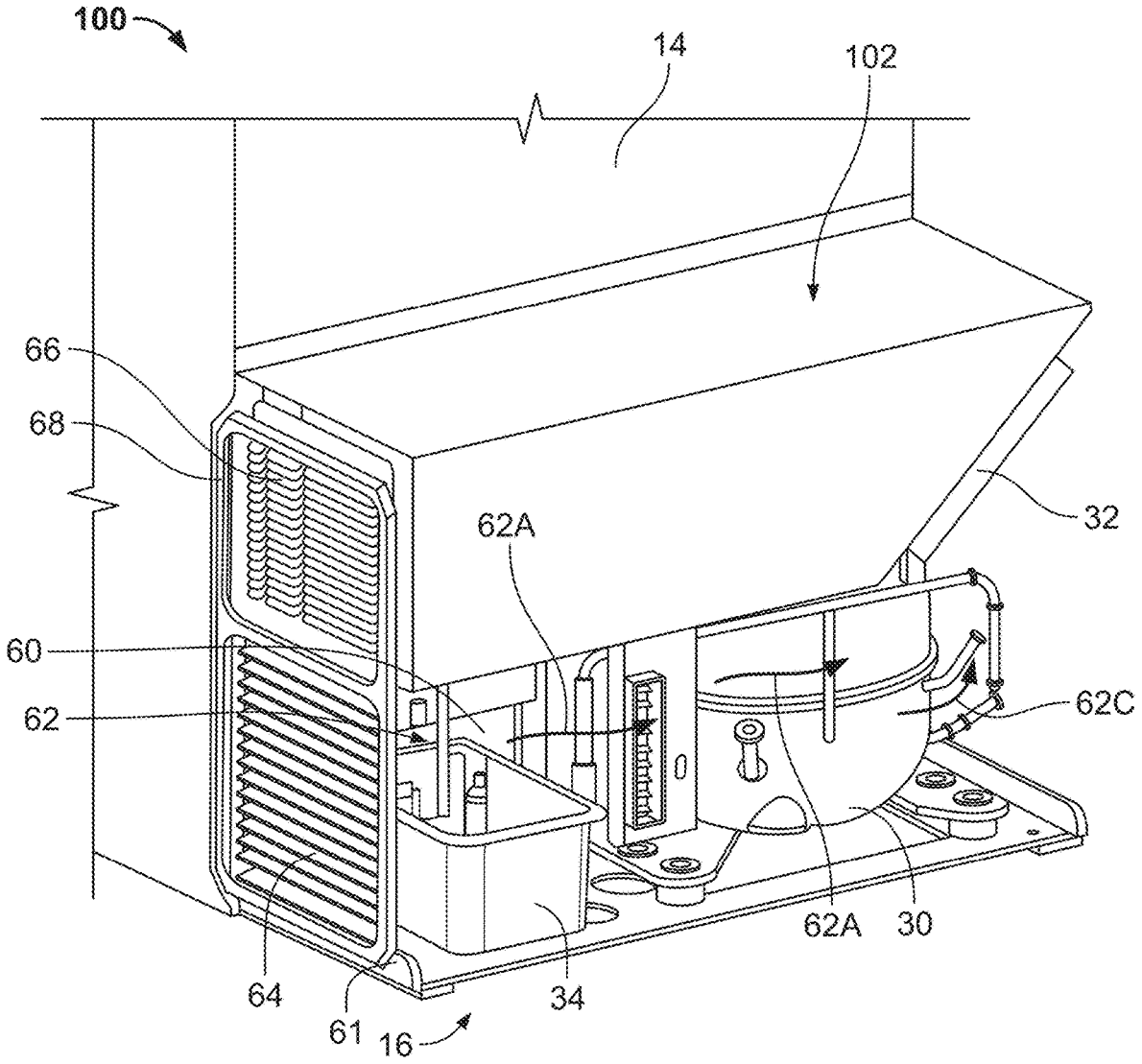
FIG. 7 is a perspective view of another refrigerator in accordance with the present teachings.
Figure 8:
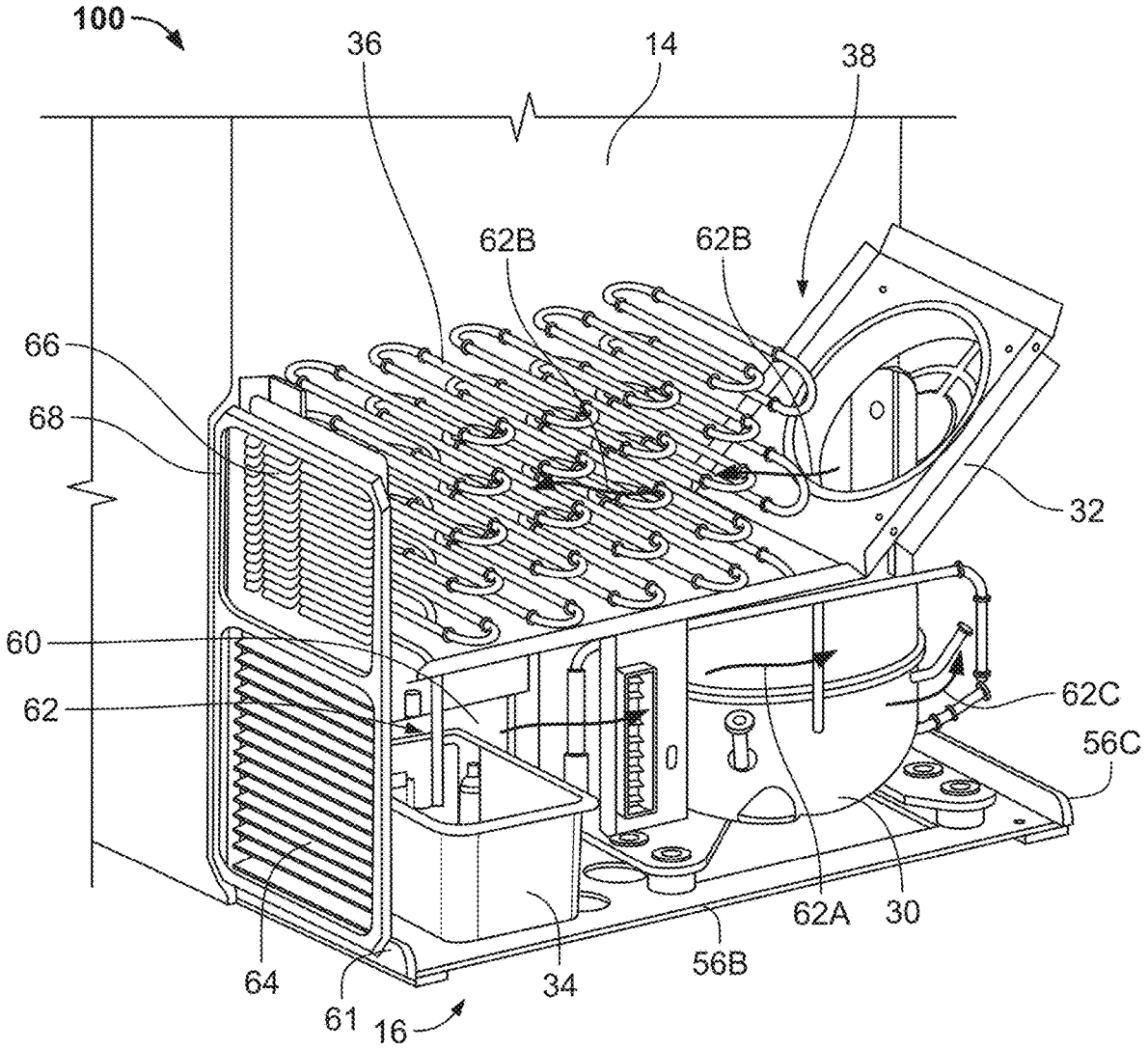
FIG. 8 is a perspective view of the refrigerator of FIG. 7 shown with a cover of the cooling unit removed for purposes of illustration.

Turning to FIGS. 7 and 8, another refrigerator in accordance with the present teachings is illustrated and generally identified at reference character 100. Given the similarities between the refrigerator 100 and the refrigerator 10, like reference characters will be used throughout the drawings to identify like elements. The refrigerator 100 of FIGS. 7 and 8 primarily differs from the refrigerator 10 of FIGS. 1-6 by incorporating a smaller, metal housing 102 instead of a larger, plastic housing 38. This metal housing 102 is shown removed in FIG. 8 for purposes of illustration.

As with the refrigerator 10, the cooling unit housing 102 defines an airflow path 62. The airflow path may be a U-shaped airflow path 62 extending between an inlet 64 and an outlet 66. The inlet and the outlet 64 and 66 are located at a common lateral side of the refrigerator 10. The airflow path 62 includes a first portion 62A horizontally extending into the cooling unit housing 56 from the inlet 64 and a second portion 66B horizontally extending to the outlet 66. An intermediate portion 62C connects the first and second portions 62A and 62B.

As illustrated in the particular embodiment shown, the housing 102 may have a rear wall and a top wall that cooperate with the ventilator 32 to include the condenser 36. To the extent not otherwise described, it will be understood that the airflow of the cooling unit 16 of the refrigerator 100 is identical to the refrigerator 10.

While specific examples have been discussed in the specification and illustrated in the drawings, it will be understood by those skilled in the art that various changes may be made and equivalence may be substituted for elements thereof without departing from the scope of the present teachings. Additionally, while the present teachings may have particular application for motor vehicles, the scope is limited in this regard. For example, various aspects of the present teachings may be readily adapted for refrigerators used in stationary applications, including but not limited to commercial and residential refrigerators. Furthermore, the mixing and matching of features, elements and/or functions between various examples may be expressly contemplated herein so that one skilled in the art would appreciate from the present teachings that features, elements and/or functions of one example may be incorporated into another example as appropriate, unless discussed otherwise above. Moreover, many modifications may be made to adapt a particular situation or material to the present teachings without departing from the essential scope thereof. Therefore, it may be intended that the present teachings not be limited to the particular examples illustrated by the drawings and discussed in the specification as the best mode of presently contemplated for carrying out the present teachings but that the scope of the present disclosure will include any embodiments following within the foregoing description and any appended claims. Finally, it will be understood that the term U-shaped as used herein is not limited to a shape with two parallel legs and an accurate intermediate portion. Rather, this term will be understood to encompass any shape with two legs either parallel are slightly askew to one another and an intermediate portion that connects the two legs. The intermediate portion may be arcuate, straight or otherwise.

What is claimed is:

1. A refrigerator comprising:

a housing defining an interior;

at least one exterior door closing the interior of the housing;

a freezer disposed within the interior and having a freezer door and an interior freezer compartment;

a cooling unit for cooling the interior of the refrigerator, the cooling unit including a heat exchanger disposed within the interior of the housing;

at least one ventilation duct vertically extending through the freezer door, the at least one ventilation duct having a first end in communication with an upper zone of the interior of the refrigerator and being isolated from the interior freezer compartment of the freezer;

an airflow path extending between the heat exchanger and a lower end of the at least one ventilation duct; and a cooling fan for directing a source of air from within the refrigerator across the heat exchanger, along the airflow path, vertically upwardly into the lower end of the at least one ventilation duct, and through the at least one ventilation duct, and out through the first end of the at least one ventilation duct, wherein the airflow path further extends fully through the at least one ventilation duct to an upper zone of the interior of the refrigerator located above the freezer.

2. The refrigerator of claim 1, wherein the at least one ventilation duct includes spaced apart first and second ventilation ducts.

3. The refrigerator of claim 1, wherein the freezer door has a front face, and wherein the first end of the at least one ventilation duct is in the front face of the freezer door.

4. The refrigerator of claim 1, wherein the airflow path includes a vertically extending section adjacent to the heat exchanger.

5. The refrigerator of claim 4, wherein the airflow path also includes a horizontally extending portion below the freezer that extends between the vertically extending portion and the at least one ventilation duct.

6. The refrigerator of claim 5, further comprising a guide blade at the lower end of the at least one ventilation duct to assist with the transition of airflow from the airflow path to the lower end of the at least one ventilation duct.

7. The refrigerator of claim 1, wherein the upper zone of the interior is completely above the heat exchanger such that cooled air from the heat exchanger is routed upward to the upper zone.

8. The refrigerator of claim 1, wherein a freezer interior of the freezer is sealed from the airflow path by the freezer door.

9. A refrigerator comprising:

a housing defining an interior;

an exterior door providing access to the interior;

a freezer disposed within the interior;

a freezer door providing access to an interior freezer compartment of the freezer;

a cooling unit for cooling the interior of the refrigerator, the cooling unit including a heat exchanger disposed within the interior of the housing;

at least one ventilation duct vertically extending through the freezer door so as to be movable with the freezer door as the freezer door is opened and closed, the at least one ventilation duct having a first end adjacent an upper area of the freezer door which is in communication with an upper zone of the interior of the refrigerator, and a second end adjacent a lower area of the freezer door;

an airflow path extending between the heat exchanger and the second end of the at least one ventilation duct; and a cooling fan for directing a cooling airflow from within the refrigerator across the heat exchanger, along the airflow path, into the second end of the at least one ventilation duct, and then fully vertically through the at least one ventilation duct, and then out through the first end of the ventilation duct and into the upper zone of the interior of the refrigerator, wherein the freezer door is inwardly spaced from the exterior door and movable relative to the freezer, wherein the interior freezer compartment of the freezer is sealed from the airflow path by the freezer door and isolated from the cooling airflow flowing through the airflow path.

10. The refrigerator according to claim 9, wherein the at least one ventilation duct includes spaced apart first and second ventilation ducts.

11. The refrigerator according to claim 9, wherein the first end of the at least one ventilation duct is in a front face of the freezer door.

12. The refrigerator according to claim 9, wherein the airflow path includes a vertically extending section adjacent to the heat exchanger.

13. The refrigerator according to claim 12, wherein the airflow path also includes a horizontally extending portion below the freezer that extends between the vertically extending section and the lower end of the at least one ventilation duct.

14. The refrigerator according to claim 13, further comprising a guide blade at the second end of the at least one ventilation duct to assist with a transition of the cooling airflow from the airflow path into the second end of the at least one ventilation duct.

15. The refrigerator according to claim 9, wherein the freezer door defines a freezer handle and the at least one ventilation duct extends through the freezer handle.

16. The refrigerator according to claim 9, wherein the cooling fan is angled upwardly.

17. The refrigerator according to claim 9, wherein that the upper zone of the interior is completely above the heat exchanger such that cooled air from the heat exchanger is routed upward to the upper zone.

18. The refrigerator according to claim 9, wherein the upper zone of the interior is a refrigeration compartment controlled to a lower temperature as compared to the freezer and the upper zone is horizontally disposed between the exterior door and the freezer door.

19. A refrigerator comprising:

a housing defining an interior;

an exterior door providing access to the interior;

a freezer disposed within the interior;

a freezer door providing access to an interior freezer compartment of the freezer;

a cooling unit for cooling the interior of the refrigerator, the cooling unit including a heat exchanger disposed within the interior of the housing for receiving a cooling airflow from an interior of the refrigerator; and at least one ventilation duct forming an airflow path vertically extending from a cooling fan, vertically through the freezer door so as to be movable laterally with the freezer door as the freezer door is opened and closed, the airflow path extending to an upper zone of an interior of the refrigerator to channel the cooling airflow received from the airflow path at an intake point elevationally below the upper zone and outside of the interior freezer compartment, up through the at least one ventilation duct to a point adjacent an upper area of the freezer door, and then to discharge the cooling airflow out from the freezer door into the upper zone, the upper zone being positioned completely above the freezer;

wherein an interior of the interior freezer compartment is sealed from the airflow path by the freezer door.

* * * * *